US005950685A

United States Patent [19]

Peulen et al.

[11] Patent Number: 5,950,685

[45] Date of Patent: Sep. 14, 1999

[54] MONOLITHIC SHED HOLDING COMPONENT FOR SERIES SHED WEAVING ROTOR

[75] Inventors: Jaques Peulen; Peter Grimm, both of Rüti, Switzerland

[73] Assignee: Sulzer Rueti AG, Rueti, Switzerland

[21] Appl. No.: 08/973,136

[22] PCT Filed: Apr. 26, 1996

[86] PCT No.: PCT/CH96/00154

§ 371 Date: Dec. 1, 1997

§ 102(e) Date: Dec. 1, 1997

[87] PCT Pub. No.: WO96/38611

PCT Pub. Date: Dec. 5, 1996

[30] Foreign Application Priority Data

Jun. 2, 1995 [CH] Switzerland ..... 1631/95

[51] Int. Cl.[6] ..... D03D 47/00; D03D 47/30

[52] U.S. Cl. ..... 139/28; 139/435.6

[58] Field of Search ..... 139/28, 435.6

[56] References Cited

U.S. PATENT DOCUMENTS

| | | | |
|---|---|---|---|
| 4,290,458 | 9/1981 | Steiner | 139/28 |
| 4,314,590 | 2/1982 | Suzuki et al. . | |
| 4,442,871 | 4/1984 | Suzuki et al. . | |
| 4,492,255 | 1/1985 | Steiner | 139/11 |
| 4,586,541 | 5/1986 | Steiner | 139/435 |
| 4,655,259 | 4/1987 | Steiner | 139/11 |

FOREIGN PATENT DOCUMENTS

| | | |
|---|---|---|
| 0 013 321 | 7/1980 | European Pat. Off. . |
| 0 143 859 | 6/1985 | European Pat. Off. . |
| 0 196 349 | 10/1986 | European Pat. Off. . |

*Primary Examiner*—Andy Falik
*Attorney, Agent, or Firm*—Townsend and Towsend and Drew LLP

[57] ABSTRACT

A blower nozzle provided for the weft thread insertion is associated with the monolithic shed holder element for the weaving rotor of a series shed weaving machine. The shed holder element is manufactured from a piece of metal. The blower nozzle is integrated into the shed holder element and comprises at least one bore placed in the shed holder element.

13 Claims, 3 Drawing Sheets

Fig. 4
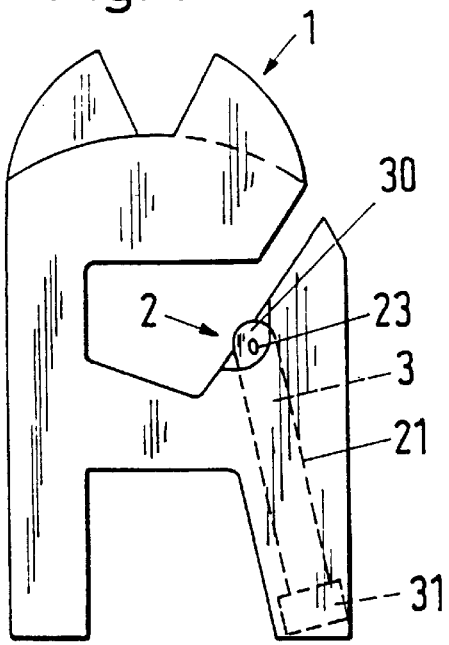
Fig. 5a
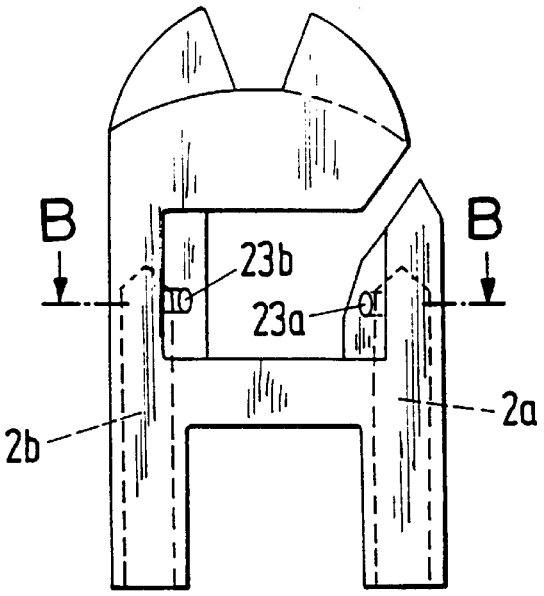
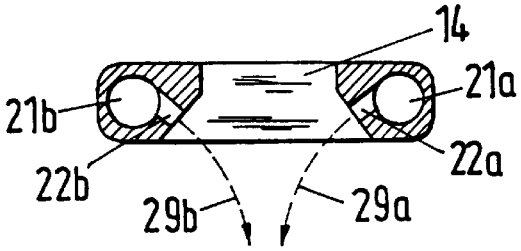
Fig.5b
Fig. 6
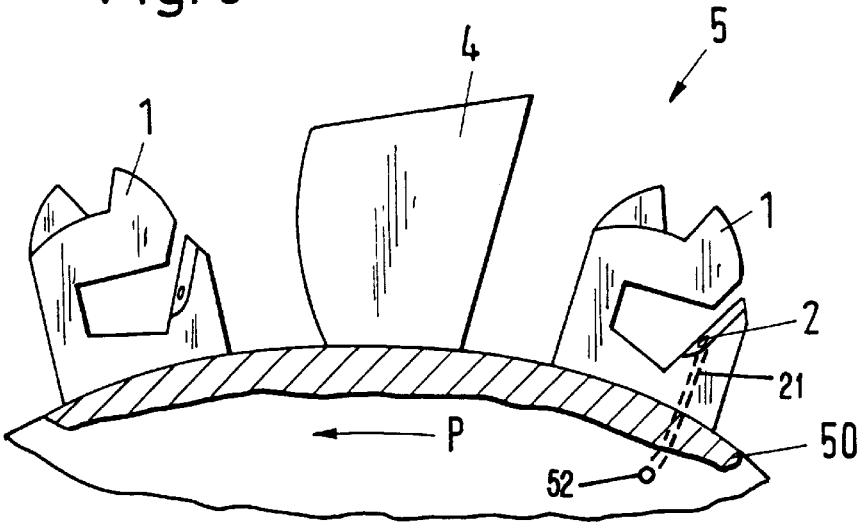

MONOLITHIC SHED HOLDING COMPONENT FOR SERIES SHED WEAVING ROTOR

BACKGROUND OF THE INVENTION

The invention relates to a monolithic shed holder element for the weaving rotor of a series shed weaving machine as well as to a weaving rotor and a weaving machine with shed holder elements in accordance with the invention.

Series shed weaving machines are multiple phase weaving machines (see e.g. EP 0 013 321) in which several weft threads displaced stepwise with respect to one another are inserted into travelling sheds, with a weaving rotor forming a plurality of sheds each of which extends over the entire cloth width. The roller-shaped weaving rotor has axially aligned blade-like combs with beat-up and guide blades. Shed holder elements are placed alternately between the guide blades and determine the upper or lower shed position of the warp threads.

Monolithic shed holder elements are known from EP 0 196 349 which each have a warp thread guidance section consisting of a passage between two projections, with the base of the passage forming the upper shed support for the warp threads. The projections have the function of the above-mentioned guide blades. The weft insertion is done by means of air jets. For individual shed holder elements a form is provided in such a manner that a space is kept free for an auxiliary blower nozzle.

These known monolithic shed holder elements are advantageously manufactured of a ceramic material as pressed parts. Instead of consisting completely of ceramics the shed holder element can for example consist of a light-weight metal, where at least the warp thread guidance section must be coated with a ceramic or other resistant material.

The auxiliary nozzle, which has an air channel as well as a suitable nozzle opening, cannot be manufactured of ceramic material or can only be manufactured of ceramic material with great cost and effort. In contrast to the case of the shed holder elements, the possibility exists of constructing the auxiliary nozzles economically of plastic. Due to rapid wear by the warp threads, plastic cannot be used for the shed holder elements.

SUMMARY OF THE INVENTION

The invention is based on the object of providing shed holder elements which can be manufactured economically. A reduction in costs results from the fact that the auxiliary nozzle is integrated into the shed holder element and need not be constructed as a separate element. A corresponding embodiment of the shed holder element using ceramic material would be very expensive, since the bores necessary for the nozzle could only be made at a high cost.

A further advantage of the integrated nozzle is that there is no problematical place of transition between the nozzle and the weft thread channel of the shed holder element. The weft thread executes an oscillatory movement swinging back and forth over the entire cross-section of the weft thread channel during the insertion. In order that the thread, so far as is possible, suffers no damage on contacts with the shed holder elements, the contour of the channel must be executed in a thread-friendly manner. Fibers of the weft thread can catch at a gap in the transition region between the nozzle and the weft thread channel. Such a problematic place would thus not be thread-friendly. The elimination of such a transition region can be considered to be a further object of the invention.

BRIEF DESCRIPTION OF THE DRAWINGS

FIG. 4 is a side view of a fourth embodiment, FIG. 5*a* is a side view of a fifth embodiment, FIG. 5*b* is a cross-section through the shed holder element of FIG. 5*a* along the line B—B, FIG. 6 is a section of a weaving rotor viewed in the direction of the axis.

DESCRIPTION OF THE PREFERRED EMBODIMENTS

Figure 1A:
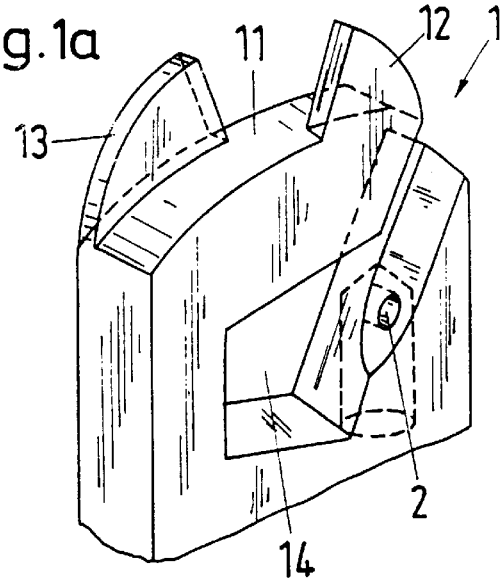
FIG. 1*a* shows the upper part of a shed holder element in accordance with the invention.
Figure 1B:
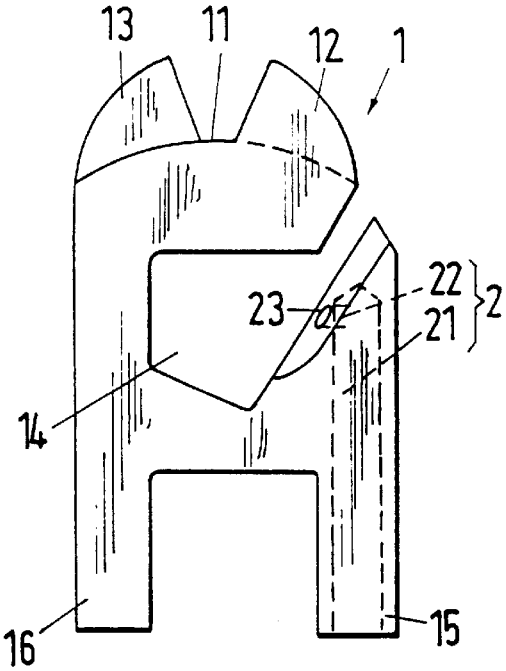
FIG. 1*b* is a side view of the exemplary embodiment of FIG. 1*a,*

The shed holder element 1 which is illustrated in FIGS. 1*a* and 1*b* has the following parts: an auxiliary blower nozzle 2 with a first bore 21 and a second bore 22, the diameter of which is smaller than that of the first bore and which forms the exit opening 23 of the nozzle 2; an upper shed support surface 11 for warp threads, which is placed between two projections 12 and 13; a weft thread channel 14; two parts 15 and 16 which are provided for fastening the shed holder element 1 in a weaving rotor 5 (cf. FIG. 6). The first bore 21 of the integrated nozzle 2 is placed in the fastener part 15. This bore 21 produces a connection to a compressed air channel 52 in the weaving rotor 5.

Figure 2:
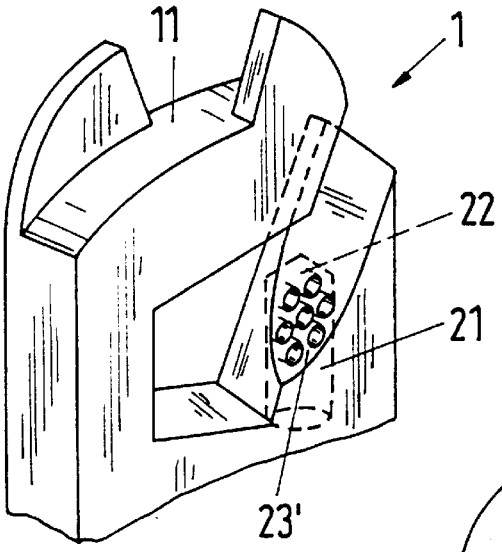
FIG. 2 shows the upper part of a shed holder element in accordance with a second embodiment.

In the second embodiment of FIG. 2 there is, instead of a single exit opening 23, a plurality of exit openings 23', which are formed by a corresponding number of bores 22 extending transverse to the bore 21.

Figure 3A:
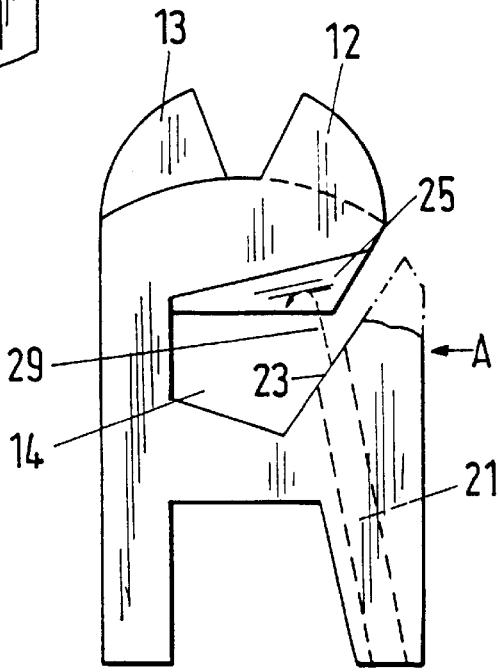
FIG. 3*a* is a side view of a third embodiment.
Figure 3B:
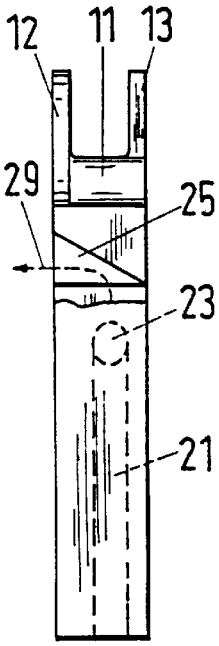
FIG. 3*b* is a view of the third embodiment in the direction of the warp thread.

In the third embodiment, which can be seen in FIGS. 3*a* and 3*b*, the blower nozzle 2 consists of a bore 21 whose only exit opening 23 is placed opposite to a surface 25 which is provided for a deflection of the air jet 29 into the weft thread channel 14.

In the fourth embodiment, FIG. 4, an insert piece 3 is placed in the bore 21 and forms a closing element 30 of the bore 21 and in which the nozzle opening 23 is located. An extension 31 is provided for an anchoring of the insertion piece 3 at the entry of the bore 21.

In the fifth embodiment, FIGS. 5*a* and 5*b*, two blower nozzles 2*a* and 2*b* are present, which are placed in a mirror image arrangement with respect to one another. If the two nozzles 2*a* and 2*b* have the same blower power, then the two air jets 29*a* and 29*b* flowing out of the two nozzles unite to a common air jet which moves in the direction of the weft thread channel 14.

The weaving rotor 5 illustrated sectionwise in FIG. 6 and viewed in the direction of the axis shows elements of three adjacent blade combs, namely a beat-up blade 4 in addition to the shed holder elements 1. The elements are placed on a roller 50 of the weaving rotor 5. The arrow P indicates the direction of rotation of the weaving rotor 5.

Figure 7:
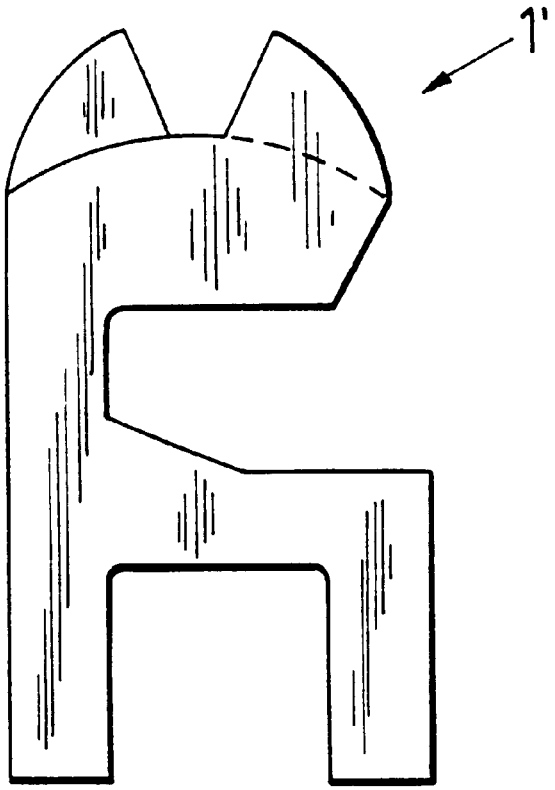
FIG. 7 shows a shed holder element in "half-tooth execution" and FIG. 8 is a section through a part of a comb which is composed of shed holder elements with and without integrated nozzles.
Figure 8:
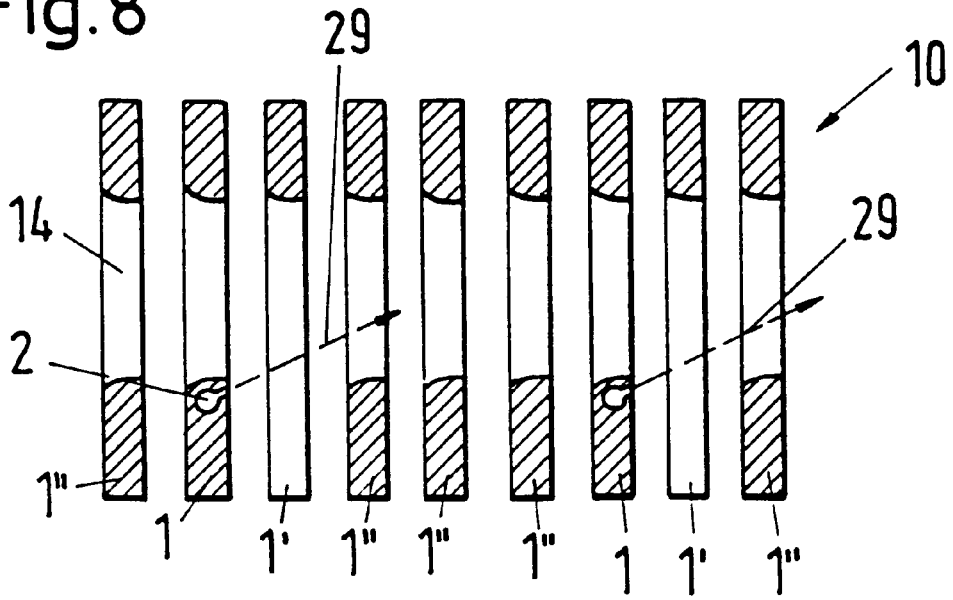

FIG. 6 shows shed holder elements 1 with integrated auxiliary blower nozzles 2. It is however sufficient if only some-shed holder elements 1 have nozzles 2. It is necessary as a rule for those shed holder elements which are adjacent to a shed holder element with an integrated nozzle 2 to have a suitable form for which no detrimental effects on the air jets 29 given off by the nozzles 2 result. FIG. 7 shows such a shed holder element 1'. A comb 10 with shed holder elements 1 (in accordance with FIG. 1), 1' (in accordance with FIG. 7) and 1" is shown in FIG. 8, with the shed holder elements 1" having no nozzles 2, but otherwise having substantially the same form as the shed holder elements 1. The section through the comb 10 extends horizontally and through the weft thread channel 14.

What is claimed is:

1. A monolithic shed holder element for a weaving rotor of a series shed weaving machine comprising a pair of projections defining therebetween a shed support surface for warp threads, the monolithic shed holder element having a weft thread channel, the monolithic shed holder element being formed of metal to include an integrated blower nozzle having at least one exit opening adjacent the weft thread channel and at least one bore in the monolithic shed holder element for providing a connection to a compressed air channel in the weaving rotor to direct air through the at least one exit opening of the integrated blower nozzle of the monolithic shed holder element.

2. A monolithic shed holder element in accordance with claim 1 wherein the integrated blower nozzle is formed of a first bore having a longitudinal axis which is configured to extend substantially radially with respect to the weaving rotor, and at least one second bore which extends transversely to the first bore.

3. A monolithic shed holder element in accordance with claim 1 including a fastener part for fastening the monolithic shed holder element to the weaving rotor, the integrated blower nozzle being formed in the fastener part.

4. A monolithic shed holder element in accordance with claim 1 wherein the integrated blower nozzle includes a first bore having a longitudinal axis which is configured to extend substantially radially with respect to the weaving rotor, and a plurality of second bores which extend transversely to the first bore, the plurality of second bores forming a plurality of exit openings for the integrated blower nozzle.

5. A monolithic shed holder element in accordance with claim 1 including two integrated blower nozzles each having at least one exit opening and at least one bore in the monolithic shed holder element, the two integrated blower nozzles being at least approximately placed in a mirror image arrangement with respect to one another.

6. A monolithic shed holder element in accordance with claim 5 wherein the two integrated blower nozzles have blower powers that are at least approximately the same.

7. A combination of a weaving rotor of a series shed weaving machine and a plurality of shed holder elements connected with the weaving motor, wherein at least some of the plurality of shed holder elements are monolithic shed holder elements, each monolithic shed holder element comprising a pair of projections defining therebetween a shed support surface for warp threads, the monolithic shed holder element having a weft thread channel, the monolithic shed holder element being formed of metal to include an integrated blower nozzle having at least one exit opening adjacent the weft thread channel and at least one bore in the monolithic shed holder element for providing a connection to a compressed air channel in the weaving rotor to direct air through the at least one exit opening of the integrated blower nozzle of the monolithic shed holder element.

8. A combination in accordance with claim 7 wherein some of the plurality of shed holder elements are formed without integrated blower nozzles.

9. A series shed weaving machine comprising a weaving rotor and a plurality of shed holder elements connected with the weaving motor, wherein at least some of the plurality of shed holder elements are monolithic shed holder elements, each monolithic shed holder element comprising a pair of projections defining therebetween a shed support surface for warp threads the monolithic shed holder element having a weft thread channel, the monolithic shed holder element being formed of metal to include an integrated blower nozzle having at least one exit opening adjacent the weft thread channel and at least one bore in the monolithic shed holder element for providing a connection to a compressed air channel in the weaving rotor to direct air through the at least one exit opening of the integrated blower nozzle of the monolithic shed holder element.

10. A series shed weaving machine in accordance with claim 9 wherein some of the plurality of shed holder elements are formed without integrated blower nozzles.

11. A monolithic shed holder element for a weaving rotor of a series shed weaving machine, the monolithic shed holder element being formed of metal to include an integrated blower nozzle having at least one exit opening and at least one bore in the monolithic shed holder element, the monolithic shed holder element including a deflection surface disposed opposite to the at least one exit opening of the integrated blower nozzle for deflecting air exiting the at least one exit opening of the integrated blower nozzle.

12. A monolithic shed holder element for a weaving rotor of a series shed weaving machine, the monolithic shed holder element being formed of metal to include an integrated blower nozzle having a bore, wherein an insert piece is arranged in the bore of the integrated blower nozzle to form a closing element of the bore with an exit opening.

13. A monolithic shed holder element for a weaving rotor of a series shed weaving machine, the monolithic shed holder element being formed of metal to include two integrated blower nozzles each having at least one exit opening and at least one bore in the monolithic shed holder element, the two integrated blower nozzles being at least approximately placed in a mirror image arrangement with respect to one another, the monolithic shed holder element including two fastener parts for fastening the monolithic shed holder element to the weaving rotor, the two integrated blower nozzles being formed respectively in the two fastener parts.

* * * * *